US006857913B2

(12) United States Patent
Shi

(10) Patent No.: US 6,857,913 B2
(45) Date of Patent: Feb. 22, 2005

(54) ELECTRICAL CONNECTOR HAVING A WIRE RECEIVING PORTION

(75) Inventor: Xian-Kui Shi, Shenzhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/604,266

(22) Filed: Jul. 7, 2003

(65) Prior Publication Data

US 2004/0224568 A1 Nov. 11, 2004

(30) Foreign Application Priority Data

May 5, 2003 (TW) ..... 92208190 U

(51) Int. Cl.[7] ..... H01R 9/22
(52) U.S. Cl. ..... 439/719; 439/942; 439/466; 439/468
(58) Field of Search ..... 439/719, 942, 439/716, 466, 468

(56) References Cited

U.S. PATENT DOCUMENTS 4,544,220 A 10/1985 Aiello et al.
5,342,221 A 8/1994 Peterson
5,759,063 A * 6/1998 Beck et al. ..... 439/465
6,135,822 A 10/2000 Hwang

* cited by examiner

*Primary Examiner*—Tho D. Ta
*Assistant Examiner*—X. Chung-Trans
(74) *Attorney, Agent, or Firm*—Wei Te Chung

(57) ABSTRACT

A connector (10)includes a housing (12) and a receiving portion (14). The housing defines a plurality of ports (120) for receiving a plurality of wires (20). The receiving portion includes a pair of opposite end walls (140) respectively extending upwardly and angularly relative to a pair of opposite ends of the housing. A first connection beam (146) is formed between distal end portions of the end walls, and a second connection beam (148) is formed between uppermost portions of the end walls and parallel to the first connection beam. Ends of the wires are received in the ports of the housing, and opposite ends of the wires are received in the receiving portion. This configuration insures alignment of ends of the wires in order.

17 Claims, 3 Drawing Sheets

ELECTRICAL CONNECTOR HAVING A WIRE RECEIVING PORTION

BACKGROUND OF INVENTION

1. Field of the Invention

The present invention relates to an electrical connector for receiving a plurality of wires, and particularly to an electrical connector with a housing and a receiving portion for alignment of a plurality of wires.

2. Description of Prior Art

Electrical connectors are widely used in personal computer (PC) systems to electrically connect a plurality of wires for carrying high currents with a mating electrical connector mounted on a printed circuit board (PCB). A typical electrical connector, such as those disclosed in U.S. Pat. Nos. 5,342,221, 4,544,220, and 6,135,822 comprises an insulative housing having a number of ports arranged in at least one row.

FIG. 3 shows a conventional electrical connector 30, and a plurality of wires 40 received in the electrical connector 30. The connector 30 comprises a broad upper portion 32, a narrow lower portion 34, and a hook portion 36. The hook portion 36 protrudes from a longitudinal sidewall of the upper portion 32, for fastening a mating electrical connector (not shown). The lower portion 34 is separated into two portions each having a plurality of spaced and aligned posts 342. The posts 342 and the upper portion 32 cooperatively define a plurality of ports 302 through a bottom face of the posts 342 and a top face of the upper portion 32. The wires 40 are received in the ports 302 respectively, and protrude out of the upper portion 32.

In use, the electrical connector 30 is received in a mainframe of a computer(not shown). Because distal ends of the wires 40 located on the upper portion 32 are numerous and long, the distal ends of the wires 40 are prone to dispersion. The dispersion state of the wires 40 may inhibit efficientuse of space in the mainframe. This difficulty hinders arrangement of other parts in the mainframe. Simultaneously, this difficulty impedes dissipation of heat generated by other parts in the mainframe.

A new electrical connector that overcomes the above-mentioned problems is desired.

SUMMARY OF INVENTION

An object of the present invention is to provide an electrical connector having a receiving portion that facilitates alignment of a plurality of wires.

In order to achieve the above object, an electrical connector in accordance with a preferred embodiment of the present invention comprises an insulative housing and a receiving portion. The housing defines a plurality of ports for receiving a plurality of wires. The receiving portion protrudes from a sidewall of the housing, and comprises a pair of opposite end walls respectively extending upwardly and angularly relative to a pair of opposite ends of the housing. A first connection beam is formed between distal end portions of the end walls, and a second connection beam is formed between uppermost portions of the end walls and parallel to the first connection beam. Ends of the wires are received in the ports of the housing, and opposite ends of the wires are received in the receiving portion. This configuration insures alignment of ends of the wires in order.

Other objects, advantages and novel features of the present invention will become more apparent from the following detailed description when taken in conjunction with the accompanying drawings, in which:

DETAILED DESCRIPTION

Reference will now be made to the drawings to describe the present invention in detail.

Figure 1:
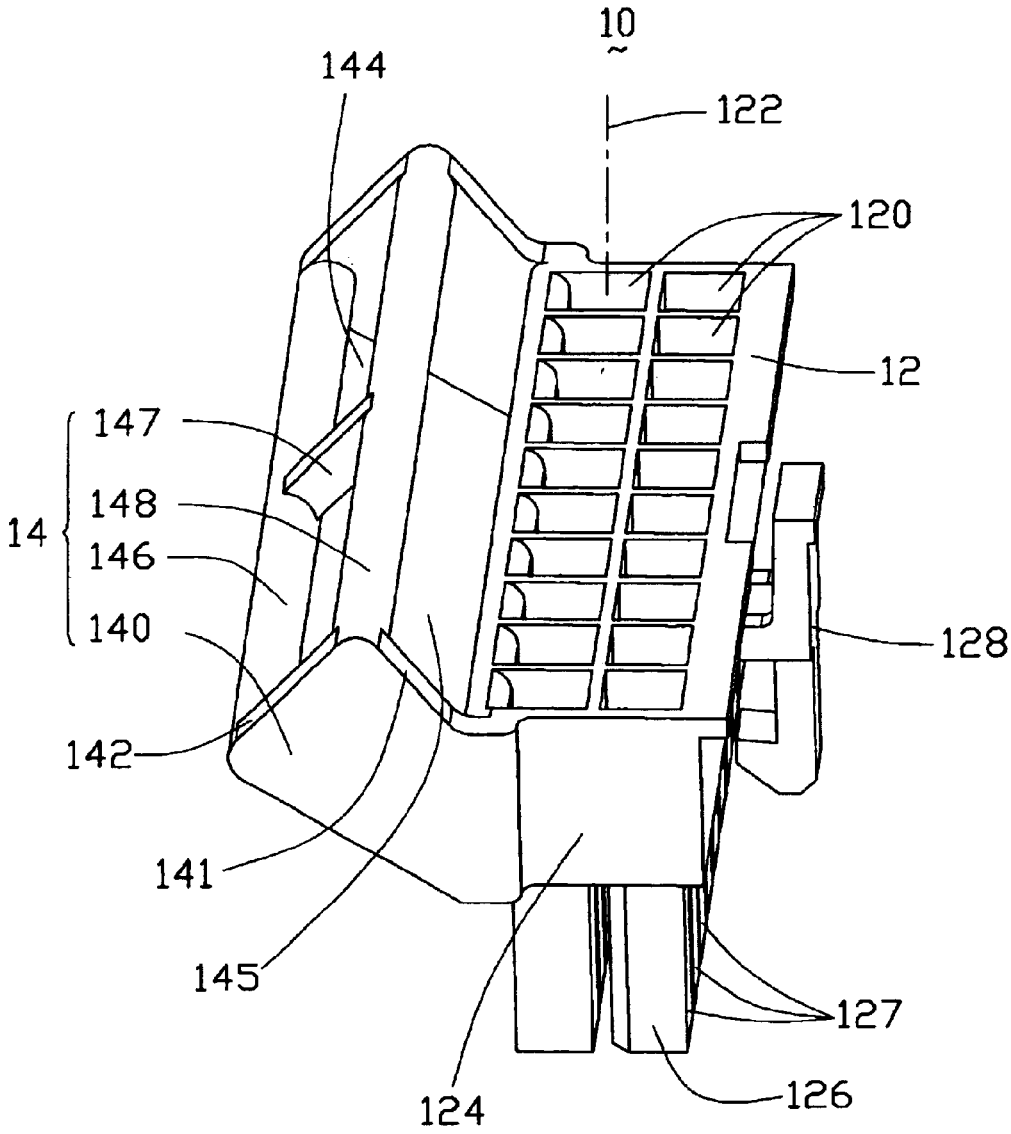
FIG. 1 is a simplified, isometric view of an electrical connector in accordance with the preferred embodiment of the present invention.
Figure 2:
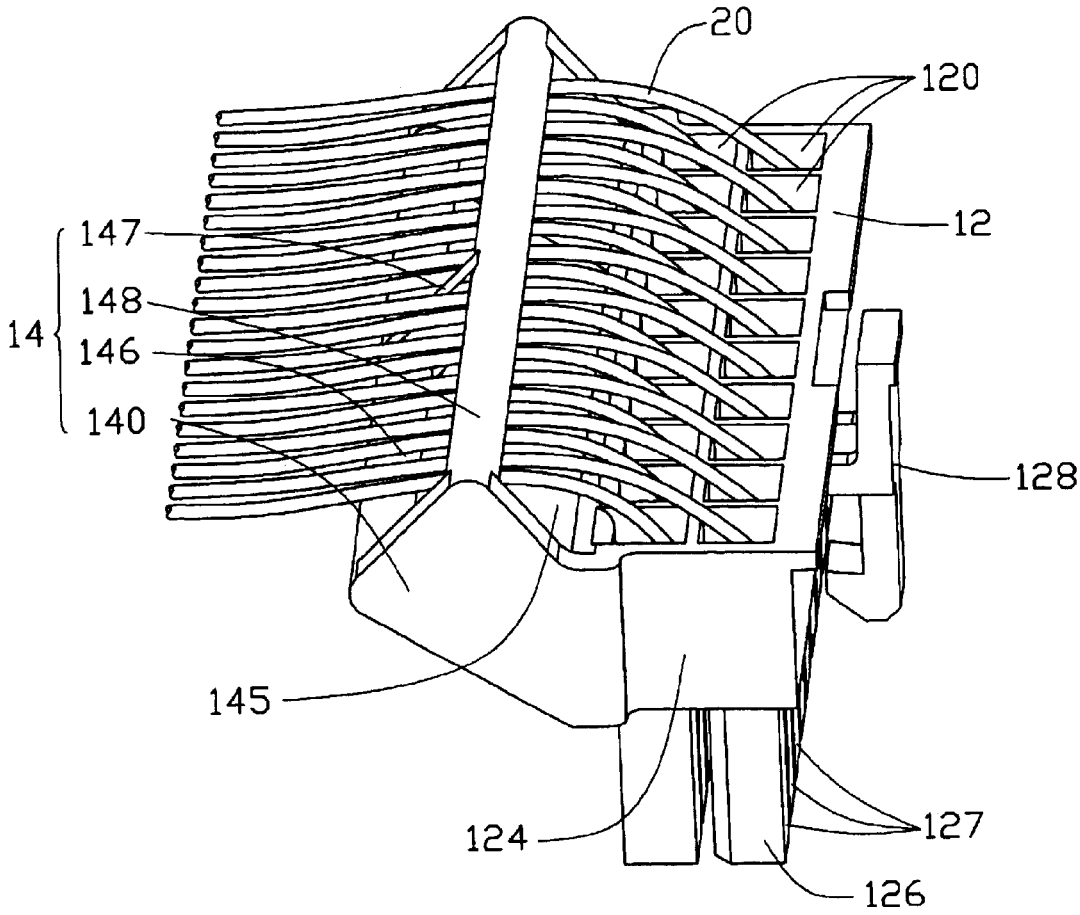
FIG. 2 is similar to FIG. 1, and showing a plurality of wires received in the electrical connector.
Figure 3:
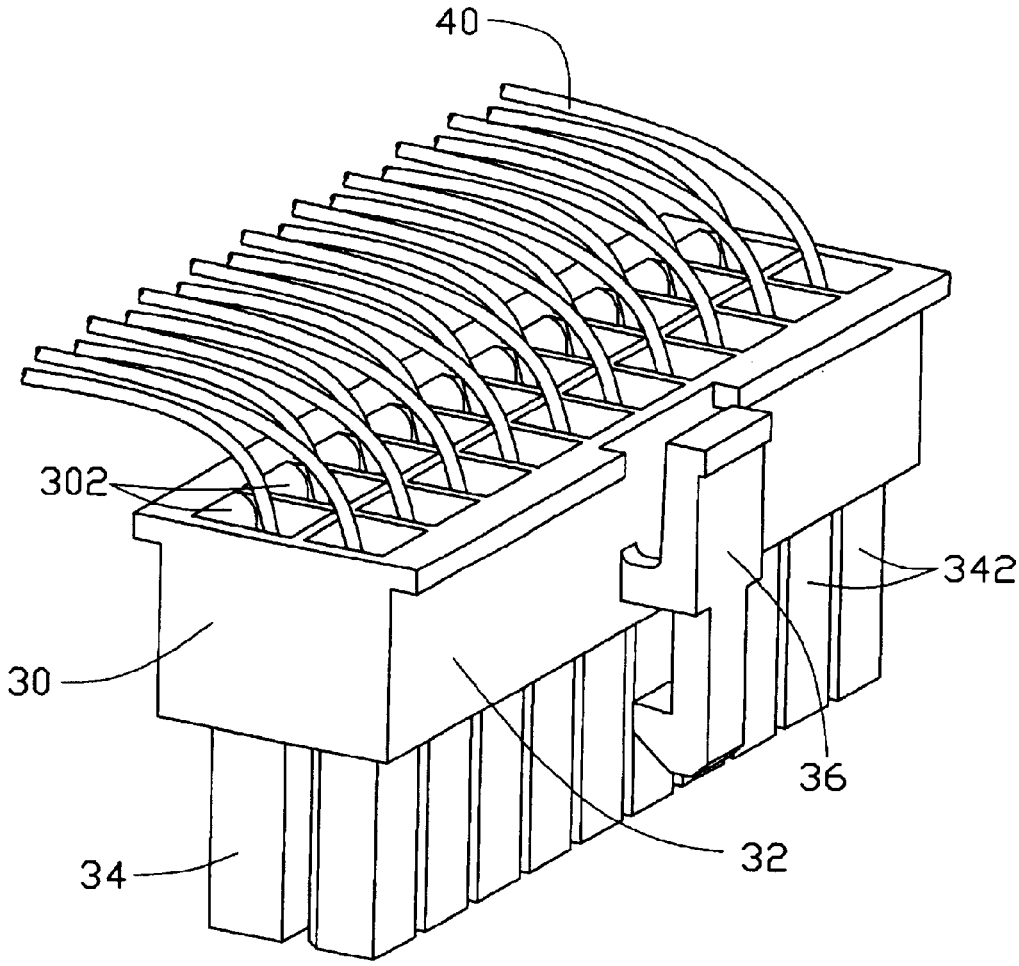
FIG. 3 (PRIOR ART)
FIG. 3 is a simplified, isometric view of a conventional electrical connector, and showing a plurality of wires received in the electrical connector.

Referring to FIGS. 1 and 2, an electrical connector 10 in accordance with the preferred embodiment of the present invention is adapted for receiving a plurality of wires 20 and being engaged with a mating electrical connector (not shown) fixed on a circuit substrate such as a printed circuit board (PCB) (not shown). The electrical connector 10 comprises an insulative housing 12, and a receiving portion 14.

The housing 12 comprises a broad upper portion 124, a narrow lower portion 126, and a hook portion 128. The hook portion 128 protrudes from a longitudinal sidewall of the upper portion 124, for engaging with the mating electrical connector. The lower portion 126 is separated into two spaced portions each having a plurality of spaced and aligned posts 127 at a longitudinal sidewall thereof. The upper portion 124 and the posts 127 cooperatively define a plurality of ports 120, the ports 120 spanning from a bottom face of the posts 127 to a top face of the upper portion 124. The ports 120 are arranged in a matrix, and for receiving the wires 20. Each port 120 defines a center axis 122.

The receiving portion 14 protrudes upwardly from an opposite longitudinal sidewall of the upper portion 124, opposite to the hook portion 128. The receiving portion 14 comprises a pair of opposite end walls 140 respectively extending upwardly from and angularly relative to a pair of opposite ends of the upper portion 124. Each end wall 140 has a first portion 141 adjoining the upper portion 124, and a second portion 142 extending downwardly from an uppermost portion (not labeled) of the first portion 141. A transverse first connection beam 146 is formed between the end walls 140 at distal end portions of the first portions 141. A transverse second connection beam 148 is formed between the end walls 140 at the uppermost portions of the second portion 141, and is parallel to the first connection beam 146. The end walls 140 and the first and second connection beams 146, 148 cooperatively define a first receiving space 144 therebetween. The end walls 140, second connection beam 148 and upper portion 124 cooperatively define a second receiving space 145 therebetween. The first and second receiving spaces 144, 145 are used for receiving the wires 20. A rib 147 is formed between the first and second connection beams 146, 148, the rib 147 being perpendicular thereto. The rib 147 reinforces structures of the first and second connection beams 146, 148, and spaces the wires 20 in the first receiving space 144. The first connection beam 146 is elevated above the second connection beam 148 in a vertical direction parallel to the center axes 122.

In assembly of the wires 20 into the electrical connector 10, ends of the wires 20 having terminals (not shown) are received through the first receiving space 144 and the second receiving space 145 of the receiving portion 14 in that order, and are then received in the ports 120. From another viewpoint, the wires 20 extend from the corresponding ports 120 outwardly beyond the rear face, i.e., upper face, and are exposed to the exterior. Thus, opposite distal ends of the wires 20 are positioned by the first and second connection beams 146, 148. In use, the electrical connector 10 is engaged with the mating electrical connector mounted on the PCB, the PCB being received in a mainframe of a computer (not shown).

In the electrical connector 10, unlike conventional electrical connectors, the distal ends of the wires 20 are aligned in the receiving portion 14. This configuration facilitates arrangement of other parts of the mainframe of the computer, and facilitates dissipation of heat generated by the other parts in the mainframe.

While a preferred embodiment in accordance with the present invention has been shown and described, equivalent modifications and changes known to persons skilled in the art according to the spirit of the present invention are considered within the scope of the present invention as defined in the appended claims.

What is claimed is:

1. An electrical connector comprising:

an insulative housing defining a plurality of ports;

a plurality of wires with ends thereof received in the ports of the housing; and a receiving portion integrally connected to the housing and receiving portions of the wires adjacent to the ends, wherein the housing comprises an upper portion, a lower portion, and a hook portion protruding from a sidewall of the upper portion; wherein the receiving portion protrudes from an opposite sidewall of the upper portion.

2. The electrical connector as claimed in claim 1, wherein the receiving portion comprises a pair of opposite end walls respectively extending upwardly and angularly relative to a pair of opposite ends of the upper portion.

3. The electrical connector as claimed in claim 2, wherein a first connection beam is formed between distal end portions of the end walls, and a second connection beam is formed between uppermost portions of the end walls.

4. The electrical connector as claimed in claim 3, wherein the first connection beam is parallel to the second connection beam.

5. The electrical connector as claimed in claim 4, wherein the end walls and the first and second connection beams cooperatively define a first receiving space therebetween.

6. The electrical connector as claimed in claim 5, wherein the end walls, the second connection beam, and the upper portion cooperatively define a second receiving space therebetween.

7. The electrical connector as claimed in claim 6, wherein a rib is formed between the first and second connection beams.

8. An electrical connector comprising:

an insulative housing defining at least one row of passageways along a lengthwise direction thereof;

at least one row of wires respective extending rearwardly from the corresponding passageways beyond a rear face of the housing, a front portion of each of said wires located in the corresponding passageways, respectively, for mechanically and electrically connected to a corresponding terminal located in the corresponding passageway; and a receiving portion located around the rear face of the housing and including a transverse beam extending along said lengthwise direction and spaced from the rear face with a distance along a vertical direction perpendicular to said lengthwise direction, a receiving space formed under the transverse beam; wherein said wires extend outwardly first in the vertical direction away from and are exposed outside of the rear face of the housing, while are successively guidably deflected, by said transverse beam, toward away from the housing in a lateral direction through said receiving space.

9. The connector as claimed in claim 8, wherein said lateral direction is perpendicular to both said lengthwise direction and said vertical direction.

10. The connector as claimed in claim 8, wherein said receiving portion is not located behind the rear face along said vertical direction but is offset from the rear face along said lateral direction and extends on a first side of the housing.

11. The connector as claimed in claim 10, further including an operation hook portion located on a second side of the housing opposite to said first side.

12. The connector as claimed in claim 8, wherein said receiving portion further includes at least a rib under the transverse beam and in the receiving space to divide said receiving space into two parts in said lengthwise direction so as to regulate the corresponding wires in at least two groups.

13. The connector as claimed in claim 8, wherein said receiving portion defines a pair of end walls extending in said lateral direction for confinement of said wires along said lengthwise direction.

14. The connector as claimed in claim 8, further including another transverse beam beside the receiving space and opposite to said transverse beam, wherein by cooperation of said two transverse beams said wires are confined in the vertical direction.

15. The connector as claimed in claim 14, wherein said another transverse beam is substantially located flush with said rear face in said vertical direction.

16. An electrical connector comprising:

an insulative housing defining at least one row of passageways along a lengthwise direction thereof;

at least one row of wires respectively extending rearwardly from the corresponding passageways beyond a rear face of the housing, a front portion of each of said wires located in the corresponding passageways, respectively, for mechanically and electrically connected to a corresponding terminal located in the corresponding passageway; and a receiving portion located around the rear face of the housing and laterally offset from said rear face so as to allow said rear face to be substantially fully exposed to an exterior in a vertical direction perpendicular to said lengthwise direction; wherein said wires extend outwardly first in the vertical direction away from and are exposed outside of the rear face of the housing, while are successively guided toward away from the housing laterally through a receiving space defined in said receiving portion.

17. The connector as claimed in claim 16, wherein said receiving portion extends from a first side of the housing while an operation hook extends from a second side of the housing opposite to said first side.

* * * * *